US008256405B2

(12) United States Patent
Atkinson et al.

(10) Patent No.: US 8,256,405 B2
(45) Date of Patent: Sep. 4, 2012

(54) BREATHER ASSEMBLY WITH STANDPIPE FOR AN INTERNAL COMBUSTION ENGINE

(75) Inventors: William H. Atkinson, New Holstein, WI (US); Dean M. Nelson, Waldo, WI (US)

(73) Assignee: Kohler Co., Kohler, WI (US)

( * ) Notice: Subject to any disclaimer, the term of this patent is extended or adjusted under 35 U.S.C. 154(b) by 545 days.

(21) Appl. No.: 12/481,782

(22) Filed: Jun. 10, 2009

(65) Prior Publication Data

US 2009/0308365 A1 Dec. 17, 2009

Related U.S. Application Data

(60) Provisional application No. 61/061,388, filed on Jun. 13, 2008.

(51) Int. Cl.
*F01M 1/00* (2006.01)

(52) U.S. Cl. ..... 123/572; 123/196 W; 123/195 HC

(58) Field of Classification Search ..... 123/572–574, 123/41.86, 195 HC, 196 W
See application file for complete search history.

(56) References Cited

U.S. PATENT DOCUMENTS

| | | | | |
|---|---|---|---|---|
| 4,453,525 | A | 6/1984 | DeBruler | |
| 4,470,389 | A | 9/1984 | Mitadera et al. | |
| 4,768,493 | A * | 9/1988 | Ohtaka et al. | 123/573 |
| 4,920,930 | A * | 5/1990 | Sakano et al. | 123/41.86 |
| 4,926,814 | A | 5/1990 | Bonde | |
| 5,205,848 | A | 4/1993 | Blanc et al. | |
| 5,329,913 | A * | 7/1994 | Suzuki et al. | 123/573 |
| 5,474,035 | A | 12/1995 | Ming et al. | |
| 5,706,769 | A * | 1/1998 | Shimizu | 123/90.23 |
| 6,105,560 | A | 8/2000 | Daidone | |
| 6,167,849 | B1 * | 1/2001 | Wilson | 123/41.86 |
| 6,394,079 | B2 | 5/2002 | Takada et al. | |
| 6,412,478 | B1 | 7/2002 | Ruehlow et al. | |
| 6,443,136 | B1 | 9/2002 | Suganami et al. | |
| 6,561,171 | B2 | 5/2003 | Burgess | |
| 6,725,850 | B2 | 4/2004 | Kurasawa et al. | |
| 7,080,636 | B2 | 7/2006 | Knaus et al. | |
| 7,243,642 | B2 * | 7/2007 | Nishikawa et al. | 123/572 |

(Continued)

FOREIGN PATENT DOCUMENTS

| | | | |
|---|---|---|---|
| JP | 62063112 | A | 3/1987 |
| JP | 2001193436 | A | 7/2001 |

*Primary Examiner* — M. McMahon
(74) *Attorney, Agent, or Firm* — Whyte Hirschboeck Dudek S.C.

(57) ABSTRACT

Disclosed herein is a breather assembly for use in an internal combustion engine and a method of operating an internal combustion engine. In at least one embodiment, the breather assembly includes an input chamber for receiving blow-by gas, the input chamber bounded at least partially by a crankcase exterior, and a standpipe situated inside the input chamber for directing blow-by gas into the input chamber. Additionally, the breather assembly can include an input drainback passage situated inside the input chamber and an output chamber situated adjacent the input chamber, the chamber having an inner wall with a one-way valve that allows blow-by gas to flow from the input chamber to the output chamber. The breather assembly can also include an output drainback aperture situated in the inner wall and an output chamber housing that substantially encloses the output chamber and includes an exhaust port for exhausting blow-by gas.

28 Claims, 4 Drawing Sheets

U.S. PATENT DOCUMENTS

2002/0046743 A1* 4/2002 Moren ..... 123/572
2002/0129586 A1 9/2002 Tanaka
2004/0069287 A1* 4/2004 Matsuda et al. ..... 123/573
2005/0229893 A1* 10/2005 Miyake et al. ..... 123/195 HC
2006/0180131 A1 8/2006 Dieterle et al.
2007/0251512 A1 11/2007 Wallington
2010/0089345 A1* 4/2010 Kim et al. ..... 123/41.86
2010/0170485 A1* 7/2010 Bram ..... 123/573

* cited by examiner

BREATHER ASSEMBLY WITH STANDPIPE FOR AN INTERNAL COMBUSTION ENGINE

CROSS-REFERENCE TO RELATED APPLICATIONS

This application claims the benefit of U.S. provisional patent application No. 61/061,388 entitled "Breather assembly with standpipe for an internal combustion engine" filed on Jun. 13, 2008, which is hereby incorporated by reference herein.

FIELD OF THE INVENTION

The present invention relates generally to internal combustion engines and, more particularly, to breather assemblies used in conjunction with internal combustion engines. In one aspect, the present invention relates to internal breather assemblies having a standpipe for use within an internal combustion engine.

BACKGROUND OF THE INVENTION

In internal combustion engines, pistons are housed within corresponding cylinders for reciprocating movement therein. Fuel and air enter a combustion chamber in a cylinder on a first side of a piston. The fuel in the combustion chamber is ignited to cause linear motion of the piston inside the respective cylinder. The linear motion of the piston is then converted to rotary motion by the crankshaft. Ideally, all of the gases in the combustion chamber(s) after ignition of the fuel would be exhausted via an engine exhaust pipe. However, a portion of the exhaust gases typically pass past the piston rings and the cylinder walls of the cylinders housing the pistons to enter the crankcase. These exhaust gases build up in the crankcase thereby pressurizing the crankcase. During routing of the exhaust gases within the crankcase, the gases often become contaminated with oil mist/oil droplets, the mixture of which is known as crankcase blow-by, or simply blow-by.

To relieve such exhaust gases from the crankcase, a breather assembly, joining the crankcase to an air intake point (e.g., an air cleaner or intake manifold), is typically attached to, or incorporated into, the internal combustion engine. A one-way valve is additionally placed in-line at an entrance hole between the breather assembly and the crankcase, such that gases escaped from the crankcase cannot return thereto. Frequently, along with the exhaust gases, some oil mist/oil droplets are invariably expelled into the breather assembly. In at least some conventional breather assemblies, at least some of the oil mist/oil droplets that pass into the breather assembly are trapped therein and tend to flow back into the crankcase due to pressure differentials and gravity via a drainback conduit.

Utility engines with breather assemblies are typically used with small power equipment, such as a lawnmower. In applications such as lawnmowers, the engine is often tilted, as would happen when cutting on a hill. Tilting an engine during operation can allow more blow-by gas that is laden with oil droplets to enter the breather assembly. Typically, for optimal removal of oil droplets from blow-by gas, an engine's breather assembly is distanced vertically upwards as far as possible from the oil reservoir. The substantial distance between the breather assembly and the oil reservoir allows gravity to remove more of the oil particles from the blow-by gas before the blow-by gas enters the breather assembly. Additionally, the distance allows the engine to be tilted off a vertical axis point while in use without significantly increasing the amount of oil droplets in the blow-by gas that enters the breather assembly, and therefore it prevents much of the blow-by gas that is heavily laden with oil droplets from entering the breather assembly and being pulled by engine vacuum or pushed by the crankcase pressure into the air intake point. The intake of substantial oil droplets in the air intake point of an engine results in excessive oil being exhausted to the engine cylinder where it is burned, thereby increasing engine oil consumption and producing excessive smoke.

Due to the particular configurations of horizontal and vertical crankshaft engines and the desire to maintain the breather entrance hole as far above the oil reservoir as possible, varied designs are often required to accommodate the breather assembly placement; this in turn limits the interchangeability among their engine components.

It would therefore be advantageous to provide an improved breather assembly that at least partially reduces the amount of oil droplets introduced into the breather assembly, particularly when an engine is tilted, as can occur during typical engine use. It would further be advantageous if such a breather assembly can provide at least some interchangeability among horizontal and vertical crankshaft engine components.

BRIEF SUMMARY OF THE INVENTION

In one aspect, the present invention relates to a breather assembly that includes an input chamber for receiving blow-by gas, the input chamber bounded at least partially by a crankcase exterior; and a standpipe situated inside the input chamber for directing blow-by gas from a crankcase interior into the input chamber. Alternatively, the input chamber of the breather assembly can be bounded substantially by the crankcase exterior, or the input chamber can have at least two sides formed from the crankcase exterior. Additionally, the breather assembly can include an input drainback passage situated inside the input chamber for draining oil from the input chamber and an output chamber situated adjacent the input chamber, wherein an inner wall is situated between the chambers, the inner wall having a one-way valve that allows blow-by gas to flow from the input chamber to the output chamber. The breather assembly further can include an output drainback aperture situated in the inner wall to provide two-way communication between the output chamber and the input chamber, and an output chamber housing that substantially encloses the output chamber and can include an exhaust port for exhausting blow-by gas. Still further, the breather assembly can include an exhaust tube connecting the exhaust port to an air intake point and a filter media situated in the input chamber.

In another aspect, the present invention relates to an internal combustion engine having a vertically situated crankshaft, a crankcase having a crankcase exterior that at least partially encloses the engine, and an input chamber for receiving blow-by gas bounded at least partially by a portion of the crankcase exterior. Alternatively, the input chamber of the internal combustion engine can be bounded substantially by the crankcase exterior, or the input chamber can have at least two sides formed from the crankcase exterior. The engine can further include a breather assembly having a standpipe situated inside the input chamber for directing blow-by gas into the input chamber. The standpipe in the breather assembly can be positioned parallel or substantially parallel with the crankshaft. Additionally, the breather assembly can include an input chamber sump situated in the input chamber for collecting oil droplets from the blow-by gas, and an input drainback passage that provides communication between the input chamber sump and an oil reservoir in the engine for draining oil. Still further, the breather assembly can include an output chamber housing situated adjacent the input chamber, having an inner wall that at least partially encloses the input chamber and an outer wall interfaced with a perimeter of the inner wall to form an output chamber therein. Yet still further, the breather assembly can include an output drainback aperture situated in a lower portion of the inner wall to provide communication between the output chamber and the input chamber sump the inner wall including a one-way valve situated above the output drainback that allows blow-by gas to flow from the input chamber to the output chamber, and an exhaust port situated in the outer wall for exhausting blow-by gas. Additionally, the breather assembly can include an exhaust tube connecting the exhaust port to an air intake point and a filter media situated in the intake chamber. Yet further, the input chamber can be substantially bounded by the crankcase exterior, or the input chamber can comprise at least two sides formed from the crankcase exterior. The internal combustion engine can further comprise an oil reservoir situated in the crankcase interior and an input drainback passage providing communication between the input chamber and the crankcase interior. In other embodiments, the internal combustion engine of claim can further comprise a crankcase extension that extends vertically from the crankcase interior into the input chamber, wherein the crankcase extension directs blow-by gas from the crankcase interior into the input chamber. Still further, the crankcase can be capable of use on a horizontal crankshaft type and/or a vertical crankshaft type internal combustion engine.

In yet another aspect, the present invention relates to a method of operating an internal combustion engine by providing an internal combustion engine comprising: a crankshaft oriented along a vertical axis, a crankcase having an exterior that at least partially surrounds the crankshaft, an oil pan secured to the crankcase, a breather assembly at least partially formed from a crankcase exterior, and a standpipe extending from the crankcase. The method further includes directing the flow of blow-by gas through the standpipe to reduce the flow of oil droplets from the crankcase into the breather assembly when the engine is at least partially tilted off the vertical axis. In alternative embodiments, the breather assembly can be bounded substantially by the crankcase exterior, or the breather assembly can have at least two sides formed from the crankcase exterior. The method can further include (i) providing an oil reservoir having at least one of a portion of the crankcase and a portion of the oil pan, for housing engine oil and receiving oil from the breather assembly; (ii) receiving blow-by gas from the standpipe into an input chamber; (iii) filtering oil droplets from the blow-by gas in the input chamber using a filter and collecting the oil droplets in an input chamber sump; (iv) draining the oil droplets from the input chamber sump to the oil reservoir using an input drainback passage; (v) releasing the blow-by gas from the input chamber through a one-way valve in an inner wall to an output chamber; (vi) exhausting the blow-by gas from the output chamber to an air intake point; and/or (vii) draining oil droplets accumulated in the output chamber to the input chamber sump through an output drainback passage.

Other embodiments, aspects, features, objectives and advantages of the present invention will be understood and appreciated upon a full reading of the detailed description and the claims that follow.

BRIEF DESCRIPTION OF THE DRAWINGS

Features of the present invention which are believed to be novel are set forth with particularity in the appended claims. Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components. In the drawings:

DETAILED DESCRIPTION OF THE PREFERRED EMBODIMENT

Figure 1:
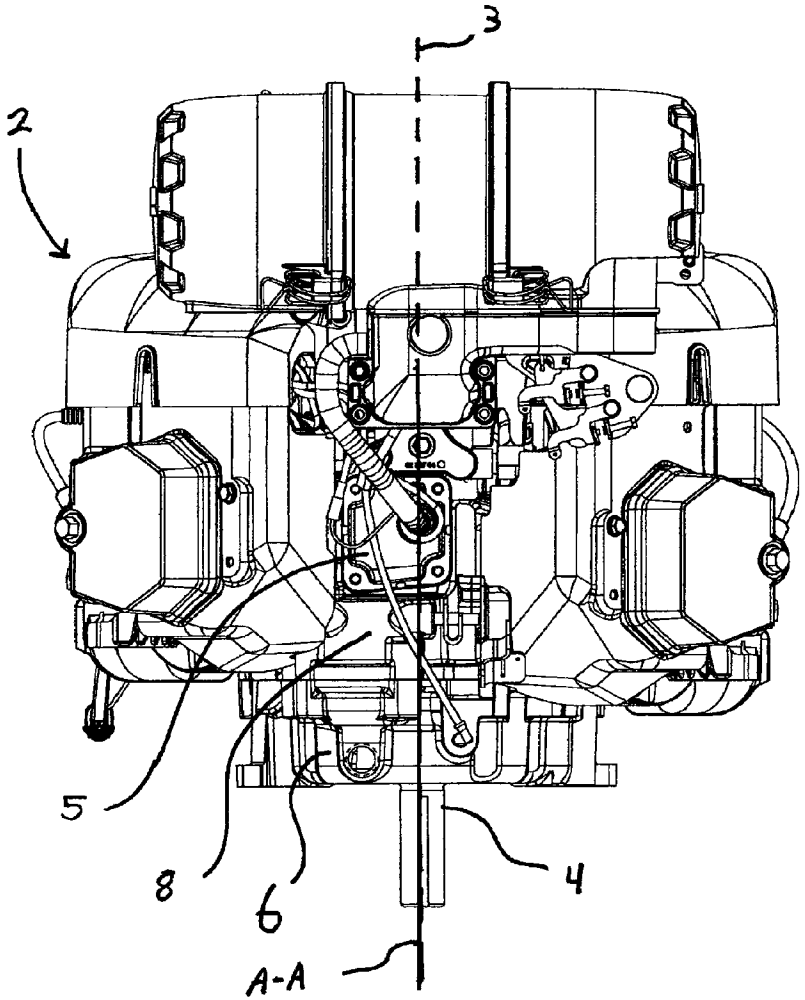
FIG. 1 is a schematic view of an internal combustion engine having a vertically oriented crankshaft, that includes an exemplary breather assembly in accordance with at least some embodiments of the present invention.

Regarding FIG. 1, a perspective view of an internal combustion engine 2 is depicted in accordance with at least some embodiments of the present invention, having a vertical axis 3. The engine 2 includes a vertically oriented crankshaft 4, an exemplary breather assembly 5 (the exterior of which is shown), an oil pan 6, a crankcase 8, and an oil reservoir (not shown). The exemplary breather assembly 5 includes a standpipe that, while not shown in FIG. 1, will be described further below. The breather assembly 5 is intended to be employed within a variety of internal combustion engines serving a variety of applications. For example, in at least some embodiments of the present invention, the breather assembly 5 can be employed with various vertical and horizontal shaft engines, including, by way of example, COMMAND PRO engines available from the Kohler Company of Kohler, Wisconsin, which are typically used in a variety of applications, such as in turf mowers, turf equipment, generators, power trowels and sawmills.

In alternate embodiments, other types of internal combustion engines can be employed. In so far as various structures and components, including for example, carburetors, air filters, intake manifolds and other related parts of a typical internal combustion engine are well known; such components are not illustrated in the figures. It can be noted that the configuration, relative operation and arrangement of the various aforementioned components is readily available and well known in the art. Therefore, for simplicity and conciseness of expression, various other types of internal combustion engines and several related components are not shown or otherwise detailed herein. Nevertheless, such components are contemplated and considered within the scope of the present invention.

Relatedly, various components associated with a conventional breather assembly, such as gaskets, seals and hoses for transporting the blow-by gas and other related structures, are not identified in the figures. Such aforementioned components and the manner of operation thereof are readily available and known to those of skill in the art and the use of such components is contemplated and considered within the scope of the present invention.

Figure 2:
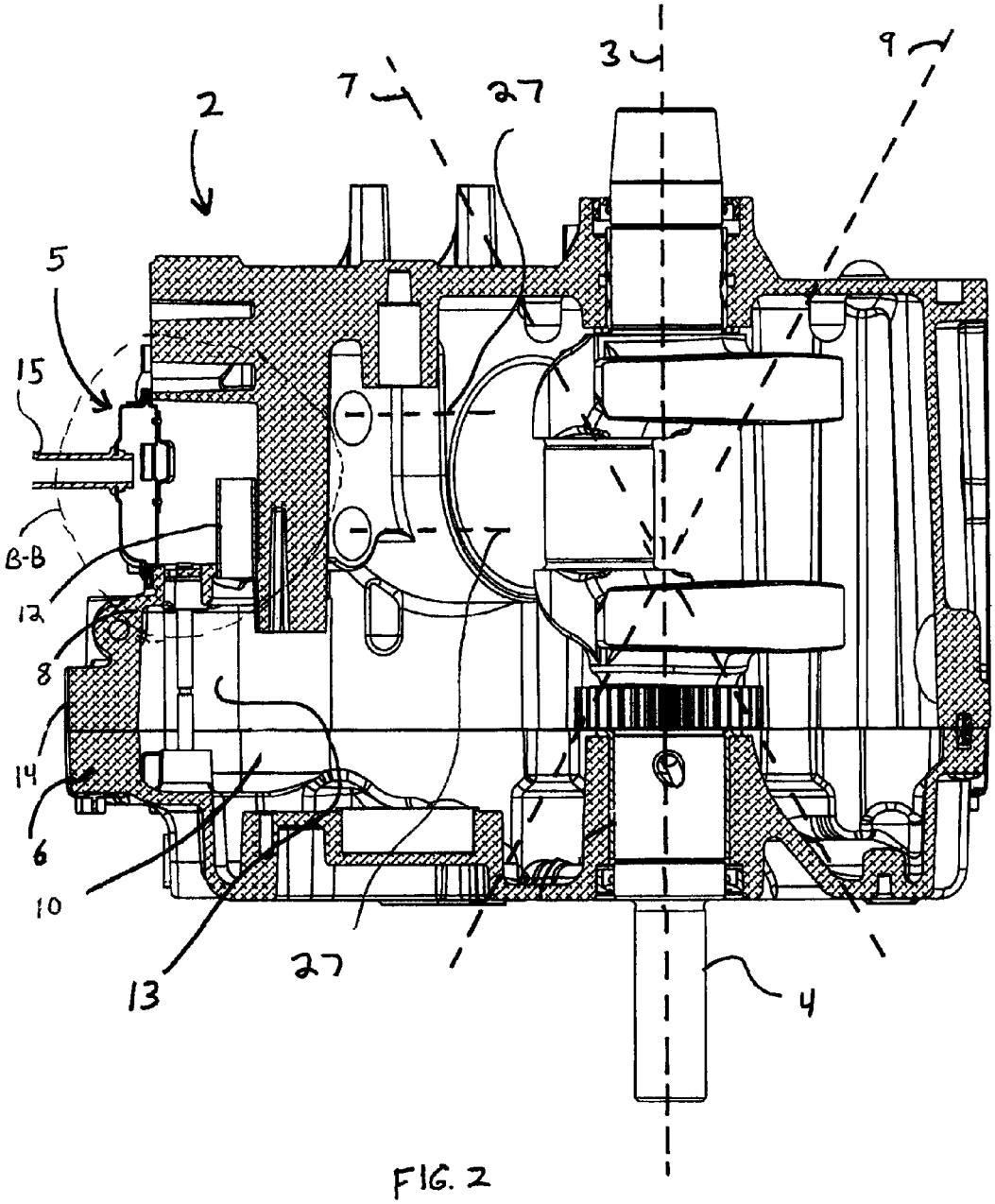
FIG. 2 is a schematic cross-sectional view of a portion of the internal combustion engine taken along line A-A of FIG. 1 depicting the exemplary breather assembly having a standpipe, an oil pan, and a crankcase, in accordance with at least some embodiments of the present invention.

FIG. 2 is a schematic cross-section of a portion of the engine 2 that depicts the oil pan 6, the crankcase 8, the oil reservoir 10, and a crankshaft 4. The schematic cross-sectional view is taken along line A-A of FIG. 1 and coincides at least in part with vertical axis 3. The engine 2 further includes the exemplary breather assembly 5 having a standpipe 12. The crankcase 8 includes a crankcase interior 13 and a crankcase exterior 14. In the present embodiment, the oil reservoir 10 comprises one or more portions of the crankcase 8 and oil pan 6 that house or contain oil, such as during operation of the engine 2.

While not shown in FIG. 2, the engine 2 typically includes an air intake point. The air intake point can be located at any of an air cleaner/air filter, an intake manifold, a carburetor of an air intake point (not shown) of the engine 2, and/or vented to the atmosphere. In accordance with at least some embodiments of the invention, the air intake point is situated at least partially exterior to the engine 2. In an exemplary embodiment, as shown in FIG. 2, the breather assembly 5 is connected via an exhaust tube 15 to the air intake point (again not shown). Further, in at least some embodiments, the breather assembly 5 can be formed as a portion of the crankcase 8 (e.g., a cavity of or in the crankcase), and in other embodiments, can comprise of one or more features that are machined into the crankcase 8. In at least some embodiments, the breather assembly 5 can be assembled or formed separately or substantially separately from the crankcase 8 and positioned in a portion of the crankcase 8. In other alternative embodiments, the breather assembly 5 can be formed and/or placed into a separate housing distinct from the crankcase 8 and be connected to the crankcase 8 via passageways or conduits. Other arrangements are contemplated and considered within the scope of the present invention. By virtue of connecting the engine crankcase 8 with the air intake point through the breather assembly 5, the breather assembly 5 provides or can function as a ventilation mechanism to evacuate blow-by gas from within the engine crankcase 8 when positive crankcase pressure exceeds a pre-determined level, thereby moving the blow-by gas into the air intake point (not shown).

Figure 3:
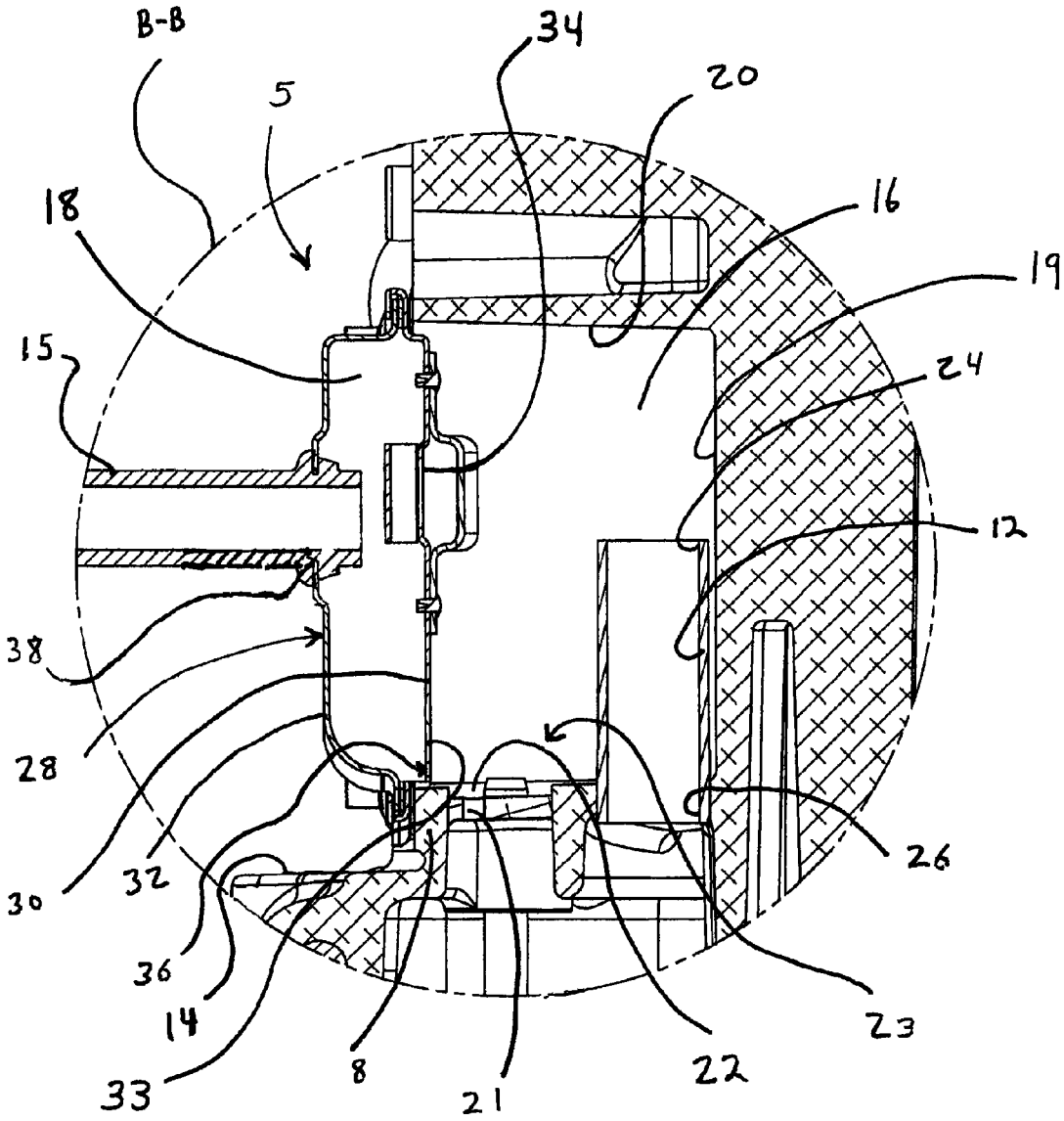
FIG. 3 illustrates an enlarged portion of the schematic cross-sectional view of the breather assembly of section A-A of FIG. 2.

Referring to FIG. 3, a typical breather assembly 5 of the type that can be used in at least some embodiments of the present invention is shown. The breather assembly 5 includes an input chamber 16 for intaking or receiving blow-by gas from inside the crankcase 8. The blow-by gas is then passed into an output chamber 18 (as described below) to exhaust the blow-by gas through the exhaust tube 15 to the air intake point (not shown). In accordance with at least some embodiments, the input chamber 16 is substantially bounded by the crankcase exterior 14, although, in general, the input chamber 16 is bounded at least partially by the crankcase exterior 14. In accordance with at least some embodiments, the input chamber 16 can be formed from at least a portion of two sides of the crankcase exterior 14, for example, a back wall 19 and a top wall 20. Still, in accordance with other embodiments, the input chamber 16 can be separately mounted from the crankcase 8. Generally, the input chamber 16 substantially encloses the standpipe 12 and, as shown, the standpipe 12 is situated adjacent the back wall 19 of the input chamber 16. The input chamber 16 further includes an input drainback 21 comprising a passage through the crankcase 8 that provides communication between an input chamber sump 22 and the oil reservoir 10 (as shown in FIG. 2), with the input chamber sump 22 being located in an input bottom portion 23 of the input chamber 16. Still further, and although not shown, the input chamber 16 can include a filtering device, such as wire mesh, baffles, or similar device, situated therein for entrapping oil droplets from the blow-by gas.

Still referring to FIG. 3, in the present embodiment, the standpipe 12 includes a pipe upper portion 24 and a pipe lower portion 26, with the pipe upper portion 24 situated inside the input chamber 16 and the pipe lower portion 26 situated at least partially into the crankcase 8, adjacent to the input chamber sump 22. In at least one aspect, the crankcase interior 13 (as shown in FIG. 2) can extend into the input chamber sump 22 to form the standpipe 12. The standpipe 12 thereby provides communication between the input chamber 16 and the crankcase 8 and oil reservoir 10 (as shown in FIG. 2). In accordance with at least some embodiments and as shown, the standpipe 12 may be a machined or otherwise formed tube. The standpipe 12 is depicted as tubular, although other shapes (e.g., square, tapered, etc.) are contemplated. In accordance with at least some embodiments and as shown, the standpipe 12 can be press fit into the crankcase, although in other embodiments, the standpipe 12 may be brazed, welded, glued, or otherwise attached or connected to the crankcase 8. Additionally, although shown in a straight or substantially straight configuration, the standpipe 12 can comprise a bent or otherwise angled portion. In general, the term "standpipe," as used herein, generally refers to any pipe, pipe-like, or similar structure that can be used or employed to convey or communicate a gas or liquid (or mixture).

In accordance with at least some embodiments and with reference to FIGS. 1-3, the standpipe 12 is situated such that it is substantially parallel to the crankshaft 4 which, as shown, is oriented along, or parallel to, the vertical axis 3. Bore axes 27, coinciding with the centers of the respective lifter bores, define a plane that is oriented perpendicular or substantially perpendicular to the length, or at least a portion of the length, of the standpipe 12 extending from the pipe lower portion 26 to the pipe upper portion 24. Still, other orientations are contemplated and are considered within the scope of the present invention. For example, the standpipe 12 can be oriented at or about 45 degrees off of, or with respect to, the vertical axis 3.

Still further and referencing FIG. 3, the output chamber 18 is situated adjacent the input chamber 16 and is at least partially enclosed by an output chamber housing 28 comprising an inner wall 30 and an outer wall 32, wherein the inner wall 30 and outer wall 32 are substantially secured together adjacent their perimeters. In general, the output chamber housing 28 can be made out of any of a variety of materials commonly employed in breather assembly construction including, for example, an aluminum or other such material casting, sheet metal stamping, and molded plastic components. Additionally, as shown in the present embodiment, the output chamber housing 28 is secured to the crankcase 8 with fasteners such that the inner wall 30 is situated substantially between the output chamber 18 and the input chamber 16. In other embodiments, the output chamber 18 may be secured in other ways (e.g., press fit, etc.) In the present embodiment, the inner wall 30 is shown in a straight, vertical orientation with respect to the engine vertical axis 3; although the inner wall 30 can also be angled or otherwise bent. The inner wall 30 further includes an inner wall lower portion 33, and a one-way valve 34 situated above the inner wall lower portion 33 that allows blow-by gas to flow from the input chamber 16 to the output chamber 18 when crankcase pressure is positive. The one-way valve 34 typically comprises a relief or check valve that can be selected from any of a wide variety of types that are commonly available. For example, in accordance with at least some embodiments, the one-way valve 34 can comprise a reed valve.

Further, the output chamber 1 8 includes an output drainback aperture 36 in the inner wall lower portion 33 adjacent the crankcase 8, and an exhaust port 38 in the outer wall 32 from which the exhaust tube 15 can be connected. Exhausted blow-by gas can be provided from the output chamber to the air intake point (not shown) via the exhaust tube 15.

During the operation of the engine 2, when an engine piston (not shown) is in a downstroke, a positive pressure is created in the crankcase 8. The positive pressure pushes blow-by gas from the crankcase 8 through the standpipe 12 and into the input chamber 16. A portion of the blow-by gas encounters the inner surface of the standpipe 12 and at least some of the oil droplets in the blow-by gas temporarily adhere to the walls and are therefore removed from the blow-by gas as it passes through to the input chamber 16. Upon entering the input chamber 16, the blow-by gas is expelled towards a filter media, such as a mesh (not shown), thereby removing at least a portion of the oil droplets when they become temporarily entrapped in the mesh. The oil droplets in the mesh flow via gravity downwards to the input chamber sump 22, and then into the crankcase 8. From the input chamber 16, the blow-by gas flows through the one-way valve 34 and into the output chamber 18. At least a portion of the blow-by gas is then at least partially forced against the walls of the output chamber 18, further removing more oil droplets from the blow-by gas as the oil droplets adhere to output chamber 18. The blow-by gas in the output chamber 18 is then expelled through the exhaust port 38 and the exhaust tube 15 that is connected to the air intake point (not shown). Additionally, more oil droplets can separate from the blow-by gas as it moves towards the air intake point and then flow down the exhaust tube 15 via gravity, into the output chamber 18. The oil droplets collected in the output chamber 18 drain via gravity through the output drainback 36 into the input chamber 16 and collect in the input chamber sump 22. The oil droplets collected in the input chamber sump 22 then drain through the input drainback 21 into the crankcase 8 and accumulate in the oil reservoir 10 (as shown in FIG. 2). Additionally, the draining of oil droplets can he assisted by a negative crankcase pressure.

In the present embodiment, when the breather assembly 5 is used with a vertically mounted crankshaft engine 2 (as shown in FIG. 2), the standpipe 12 allows the breather assembly 5 to be situated on the engine 2 in a low position relative to the oil reservoir 10 along the vertical axis, referenced by numeral 3. The standpipe 12 increases the vertical distance, corresponding to the length of the standpipe extending from the pipe lower portion 26 to the pipe upper portion 24, along the vertical axis 3 that the blow-by gas travels before entering the breather assembly 5. Therefore, the standpipe 12 raises the effective height that the blow-by gas must travel before entering the input chamber 16, thereby simulating a breather assembly that is mounted at a greater vertical distance from the oil reservoir. When the engine 2 is tilted off its vertical axis 3, for example as shown in FIG. 2, by tilted or angled axes 7 and 9, respectively, the oil level in the oil reservoir 10 is raised on the tilted side thereby positioning the oil closer to the breather assembly 5. Referring to FIG. 3, when the oil level is closer to the breather assembly 5, the blow-by gas that reaches the pipe lower portion 26 is heavily laden with oil droplets. The standpipe 12 raises the effective height required for the blow-by gas to enter the input chamber 16, thereby allowing gravity to pull oil droplets from the blow-by gas as the blow-by gas is directed upwards through the standpipe 12 towards the pipe upper portion 24. Because an increased quantity of oil droplets are removed from the blow-by gas before it enters the input chamber 16, the flow of oil from the crankcase 8 into the input chamber 16 is reduced. Additionally, the inside of standpipe 12 provides increased surface area to which the oil droplets in the blow-by gas can adhere as the blow-by gas is directed by the standpipe 12 to the input chamber 16, thereby further reducing the amount of oil droplets that reach the input chamber 16. Further, by extending the standpipe 12 and/or the input chamber 16 vertically upwards, a larger degree of tilting can be achieved without excessive oil consumption. Additionally, excessive pooling of oil droplets in the inner chamber sump 26 can be reduced or minimized while the engine 2 is tilted, by positioning the input drainback 21 adjacent the inner wall 30 and the standpipe 12 adjacent the back wall 19. Although this positioning is preferred, other positions are contemplated and considered within the scope of the present invention.

Figure 4:
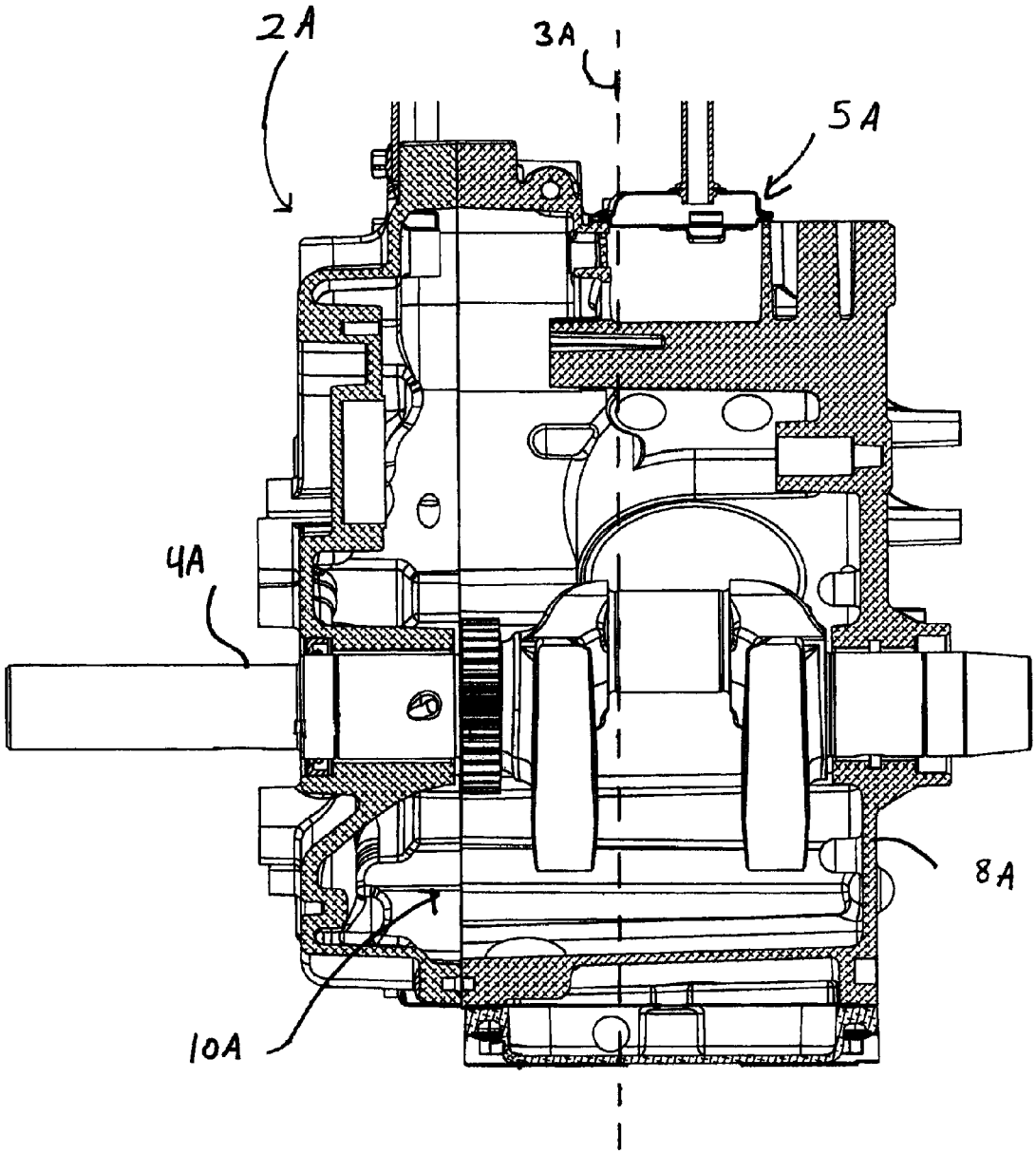
FIG. 4 is a schematic cross-sectional view showing a portion of an internal combustion engine with a horizontally oriented crankshaft that includes the exemplary crankcase of FIG. 1.

With reference to FIG. 4, a breather assembly 5A is shown on a horizontally mounted crankshaft engine 2A, having a horizontally oriented crankshaft 4A. The breather assembly SA is substantially the same as the breather assembly 5 described above with reference to FIGS. 1-4, however, in the present embodiment, no standpipe is included. The previously described standpipe would typically not be necessary since in the horizontally mounted crankshaft engine 2A, the breather assembly 5A is positioned high above the oil reservoir 10A. The high positioning of the breather assembly 5A relative to the oil reservoir 10A typically eliminates the need for a standpipe to reduce the amount of oil droplets from reaching the breather assembly 5A.

As shown in FIG. 3, breather assembly 5 having a standpipe 12 is installed on a vertically mounted crankshaft engine 2 and is shown mounted relative to, and includes a portion of, crankcase 8. As shown in FIG. 4, breather assembly 5A (which does not include a standpipe) is installed on a horizontally mounted crankshaft engine 2A and is shown mounted relative to, and includes a portion of, crankcase 8A. Crankcase 8 is identical or nearly identical to crankcase 8A. The ability to use a single type of crankcase in both horizontal and vertical crankshaft applications advantageously provides for reduced manufacturing costs and less varied inventory.

It is specifically intended that the present invention not be limited to the embodiments and illustrations contained herein, but include modified forms of those embodiments including portions of the embodiments and combinations of elements of different embodiments as come within the scope of the following claims.

We claim:

1. An internal combustion engine comprising:

a vertically situated crankshaft;

a breather assembly including an input chamber for receiving blow-by gas and a standpipe situated inside or substantially inside the input chamber for directing blow-by gas into the input chamber; and a crankcase having a crankcase interior and a crankcase exterior, wherein the crankcase exterior at least partially encloses the engine and at least partially bounds the input chamber, wherein a portion of the crankcase serves as at least apart of an oil reservoir of the engine, and wherein the input chamber of the breather assembly is at a vertically low position relative to the oil reservoir and is not atop the crankcase.

2. The internal combustion engine of claim 1, wherein the standpipe is situated parallel or substantially parallel with the crankshaft.

3. The internal combustion engine of claim 1, wherein the input chamber includes an input chamber sump for collecting oil droplets from the blow-by gas and an input drainback passage that provides communication between the input chamber sump and an oil reservoir in the engine for draining oil.

4. The internal combustion engine of claim 3, further including an output chamber housing situated adjacent the input chamber, having an inner wall that at least partially encloses the input chamber, and an outer wall interfaced with a perimeter of the inner wall to form an output chamber therein.

5. The internal combustion engine of claim 4, further including an output drainback aperture situated in a lower portion of the inner wall to provide communication between the output chamber and the input chamber sump.

6. The internal combustion engine of claim 5, further including a one-way valve situated in the inner wall above the output drainback, that allows blow-by gas to flow from the input chamber to the output chamber, and an exhaust port situated in the outer wall for exhausting the blow-by gas.

7. The internal combustion engine of claim 6, further including an exhaust tube connecting the exhaust port to an air intake point.

8. The internal combustion engine of claim 7, further including a filter media situated in the input chamber.

9. The internal combustion engine of claim 1, wherein the input chamber is substantially bounded by the crankcase exterior.

10. The internal combustion engine of claim 1, wherein the input chamber has at least two sides formed from the crankcase exterior.

11. The internal combustion engine of claim 1, further comprising an oil reservoir situated in the crankcase interior and an input drainback passage providing communication between the input chamber and the crankcase interior.

12. The internal combustion engine of claim 1, wherein the crankcase is capable of use on a horizontal crankshaft type and/or a vertical crankshaft type internal combustion engine.

13. A method of operating an internal combustion engine comprising:

providing an internal combustion engine comprising: a crankshaft oriented along a vertical axis, a crankcase having an exterior that at least partially surrounds the crankshaft, an oil pan secured to the crankcase, an oil reservoir comprising at least one of a portion of a crankcase interior and a portion of the oil pan, a breather assembly at least partially formed from a crankcase exterior, and a standpipe extending from the crankcase, wherein an input chamber of the breather assembly is at a vertically lowposition relative to the oil reservoir and not atop the crankcase; and directing the flow of blow-by gas through the standpipe to reduce the flow of oil droplets from the crankcase into the breather assembly when the engine is at least partially tilted off the vertical axis.

14. The method of claim 13, further comprising using the oil reservoir for housing engine oil and receiving oil from the breather assembly.

15. The method of claim 13, further comprising receiving blow-by gas from the standpipe into an input chamber.

16. The method of claim 15, further comprising filtering oil droplets from the blow-by gas in the input chamber using a filter and collecting the oil droplets in an input chamber sump.

17. The method of claim 16, further comprising draining the oil droplets from the input chamber sump to the oil reservoir using an input drainback passage.

18. The method of claim 13, further comprising releasing the blow-by gas from the input chamber through a one-way valve in an inner wall to an output chamber.

19. The method of claim 18, further comprising exhausting the blow-by gas from the output chamber to an air intake point.

20. The method of claim 19, further comprising draining oil droplets accumulated in the output chamber to the input chamber sump through an output drainback passage.

21. The internal combustion engine of claim 20, wherein the input chamber is substantially bounded by the crankcase exterior.

22. The internal combustion engine of claim 20, wherein the input chamber has at least two sides formed from the crankcase exterior.

23. The internal combustion engine of claim 20, wherein the crankcase is capable of use on a horizontal crankshaft type and/or a vertical crankshaft type internal combustion engine.

24. An internal combustion engine comprising:

a vertically situated crankshaft;

a breather assembly including an input chamber for receiving blow-by gas and a standpipe situated inside or substantially inside the input chamber for directing blow-by gas into the input chamber, wherein the input chamber includes an input chamber sump for collecting oil droplets from the blow-by gas and an input drainback passage that provides communication between the input chamber sump and an oil reservoir in the engine for draining oil;

a crankcase having a crankcase interior and a crankcase exterior, wherein the crankcase exterior at least partially encloses the engine and at least partially bounds the input chamber;

an output chamber housing situated adjacent the input chamber, having an inner wall that at least partially encloses the input chamber, and an outer wall interfaced with a perimeter of the inner wall to form an output chamber therein; and an output drainback aperture situated in a lower portion of the inner wall to provide communication between the output chamber and the input chamber sump.

25. The internal combustion engine of claim 24, further including a one-way valve situated in the inner wall above the output drainback, that allows blow-by gas to flow from the input chamber to the output chamber, and an exhaust port situated in the outer wall for exhausting the blow-by gas.

26. The internal combustion engine of claim 25, further including an exhaust tube connecting the exhaust port to an air intake point.

27. The internal combustion engine of claim 26, further including a filter media situated in the input chamber.

28. The internal combustion engine of claim 24, wherein the standpipe is situated parallel or substantially parallel with the crankshaft.

* * * * *